US007868722B2

(12) United States Patent
Hwang et al.

(10) Patent No.: US 7,868,722 B2
(45) Date of Patent: Jan. 11, 2011

(54) INDUCTOR APPARATUS, CIRCUIT BOARD, AND ELECTRONIC DEVICE USING THE SAME

(75) Inventors: Sung-ho Hwang, Suwon-si (KR); Jeong-il Kang, Yongin-si (KR); Pil-yong Oh, Suwon-si (KR); Jin-hyun Cho, Seoul (KR); Sang-hoon Lee, Ulsan (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 622 days.

(21) Appl. No.: 11/562,664

(22) Filed: Nov. 22, 2006

(65) Prior Publication Data

US 2007/0146108 A1 Jun. 28, 2007

(30) Foreign Application Priority Data

Dec. 22, 2005 (KR) ..... 10-2005-0127904

(51) Int. Cl.
*H01F 27/06* (2006.01)
*H01F 27/02* (2006.01)
*H01F 5/00* (2006.01)
*H01F 27/28* (2006.01)

(52) U.S. Cl. ..... 336/65; 336/67; 336/90; 336/200; 336/229; 336/232

(58) Field of Classification Search ..... 336/90, 336/200, 232, 229, 65, 67
See application file for complete search history.

(56) References Cited

U.S. PATENT DOCUMENTS 3,290,635 A 12/1966 Hofmann et al.
4,498,067 A * 2/1985 Kumokawa et al. ..... 336/65
4,612,246 A 9/1986 Goldberg et al.
4,623,865 A 11/1986 Kiesel et al.
4,754,250 A * 6/1988 Duin ..... 336/65
5,675,121 A * 10/1997 Machado ..... 174/549
5,706,358 A * 1/1998 Ashworth ..... 381/152
5,977,853 A * 11/1999 Ooi et al. ..... 336/65
6,642,827 B1 * 11/2003 McWilliams et al. ..... 336/107
6,873,234 B2 * 3/2005 Kyouno et al. ..... 335/278
6,912,133 B2 * 6/2005 Kazem ..... 361/752
2004/0017033 A1 * 1/2004 Ichikawa et al. ..... 267/140.14

(Continued)

FOREIGN PATENT DOCUMENTS

CN 1220542 6/1999

(Continued)

OTHER PUBLICATIONS

European Search Report issued Jul. 7, 2009 in EP Application No. 06077082.3.

(Continued)

*Primary Examiner*—Anh T Mai
*Assistant Examiner*—Tszfung Chan
(74) *Attorney, Agent, or Firm*—Stanzione & Kim, LLP

(57) ABSTRACT

An inductor apparatus including an inductor having a core formed in a loop shape to form a hollow part, and a coil winding the core, and a supporting member having a supporting surface to support the core to face the hollow part, and a vibration preventing hole formed to correspond to the hollow part of the core.

23 Claims, 4 Drawing Sheets

U.S. PATENT DOCUMENTS

2005/0046534 A1 * 3/2005 Gilmartin et al. ..... 336/83

FOREIGN PATENT DOCUMENTS

| | | | | |
|---|---|---|---|---|
| DE | 3440985 | | | 5/1985 |
| EP | 0524087 | | | 1/1993 |
| EP | 1148522 | | | 10/2001 |
| GB | 603309 | | | 6/1947 |
| JP | 01243407 | A | * | 9/1989 |
| JP | 06061062 | A | * | 3/1994 |
| JP | 08-97575 | | | 4/1996 |
| JP | 08138944 | A | * | 5/1996 |
| JP | 09148141 | A | * | 6/1997 |
| JP | 2000-223363 | | | 8/2000 |
| JP | 2001-275312 | | | 10/2001 |

OTHER PUBLICATIONS

Chinese Office Action issued Jul. 10, 2009 in CN Application No. 2006101669901.

* cited by examiner

INDUCTOR APPARATUS, CIRCUIT BOARD, AND ELECTRONIC DEVICE USING THE SAME

CROSS-REFERENCE TO RELATED APPLICATIONS

This application claims priority from Korean Patent Application No. 2005-0127904, filed on Dec. 22, 2005, in the Korean Intellectual Property Office, the disclosure of which is incorporated herein by reference in its entirety.

BACKGROUND OF THE INVENTION

1. Field of the Invention

The present general inventive concept relates to an inductor apparatus, a circuit board and an electronic device using the same, and more particularly, to an inductor apparatus, a circuit board and an electronic device using the same which is capable of minimizing noises and vibrations.

2. Description of the Related Art

Generally, an inductor induces voltage in proportion to variation of current. The inductor prevents rapid variation of current in an electric circuit and filters an electric noise. As a basic circuit element, the inductor has been used widely in an electronic device, an oscillating circuit, a current storage component or the like together with a resistor and a capacitor.

FIG. 1 is a plane view illustrating a conventional inductor apparatus, and FIG. 2 is a side view illustrating the inductor apparatus in FIG. 1, which generates vibrations. As illustrated in FIGS. 1 and 2, an inductor apparatus 101 includes an inductor 110, a supporting member 120 and a substrate 130. The inductor 110 includes a core 112 formed in a circular loop shape, and a coil 114 winding the core 112. The inductor 110 is supported to the supporting member 120 to be mounted on the substrate 130. The inductor 110 is applied with current from the substrate 130 to perform a predetermined function.

The supporting member 120 supports the inductor 110 on a surface thereof. A supporting pin 122 supports the supporting member 120 to the substrate 130. Other circuit elements (not illustrated) are mounted on the substrate 130.

However, in the inductor apparatus 101, noises and vibrations may be caused by an electromagnetic force generated from the inductor 110 according to variation of current. Referring to the right-screw rule, if current flows in a direction "i," a magnetic field is formed to have a direction "B." Then, referring to the right-hand rule, an electromagnetic force is generated to have a direction "F" to the coil 114.

Since the inductor 110 is fixed to the supporting member 120, the electromagnetic force generated to the coil 114 is transferred to the core 112, and to the supporting member 120. Accordingly, referring to "a" in FIG. 2, the electromagnetic force having the direction "F" causes vibration to the supporting member 120. The vibration of the supporting member 120 is transferred to the substrate 130 and the circuit elements mounted thereon, and thereby damages or deforms the substrate 130 and the circuit elements. Especially, in the case in which a high current signal of 20 Hz ~200 kHz is input the inductor 110, an electromagnetic force generated to the coil 114 may cause vibration having an audio frequency, and thereby causes noises.

SUMMARY OF THE INVENTION

The present general inventive concept provides an inductor apparatus, a circuit board and an electronic device using the same, which is capable of minimizing noises and vibrations.

Additional aspects and advantages of the present general inventive concept will be set forth in part in the description which follows and, in part, will be obvious from the description, or may be learned by practice of the general inventive concept.

The foregoing and/or other aspects and utilities of the present general inventive concept can be achieved by providing an inductor apparatus including an inductor having a core formed in a loop shape to form a hollow part, and a coil winding the core, and a supporting member including a supporting surface supporting the core to face the hollow part, and a vibration preventing hole formed to correspond to the hollow part of the core.

The core can be formed in a circular shape, and the vibration preventing hole can be formed in a circular shape to have the same center as the core.

The core can be formed in a circular shape, and the vibration preventing hole can be formed in a regular polygonal shape to have the same center as the core.

The core can be formed in one of a circular shape, an oval shape and a polygonal shape, and the vibration preventing hole can be formed in one of a circular shape, an oval shape and a polygonal shape.

The core and the vibration preventing hole can have the same center.

The vibration preventing hole can have a size to correspond to the hollow part.

The inductor apparatus may further include a first vibration preventing member formed of an elastic material to be interposed between the core and the supporting member.

The inductor apparatus may further include a substrate to which the supporting member is supported so that the inductor is mounted on the substrate, and a second vibration preventing member formed of an elastic material to be interposed between the supporting member and the substrate.

The coil may include a PEW wire.

The inductor apparatus may further include a substrate on which the inductor is mounted, wherein the supporting member includes a supporting pin extending from a circumference surrounding the supporting surface to be supported to the substrate.

The foregoing and/or other aspects and utilities of the present general inventive concept can be also achieved by providing a circuit board including a substrate, an inductor having a core formed in a loop shape to form a hollow part, and a coil winding the core, and a supporting member having a supporting surface supporting the core to face the hollow part and a vibration preventing hole formed to correspond to the hollow part of the core, and mounting the inductor on the substrate.

The core can be formed in a circular shape, and the vibration preventing hole can be formed in a circular shape to have the same center as the core.

The core can be formed in a circular shape, and the vibration preventing hole can be formed in a regular polygonal shape to have the same center as the core.

The core can formed in one of a circular shape, an oval shape and a polygonal shape, and the vibration preventing hole can be formed in one of a circular shape, an oval shape and a polygonal shape.

The core and the vibration preventing hole can have the same center.

The vibration preventing hole can have a size to correspond to the hollow part.

The circuit board can further include a first vibration preventing member formed of an elastic material to be interposed between the core and the supporting member.

The circuit board can further include a second vibration preventing member formed of an elastic material to be interposed between the supporting member and the substrate.

The coil can include a PEW wire.

The supporting member can include a supporting pin extending from a circumference surrounding the supporting surface to be supported to the substrate.

The foregoing and/or other aspects and utilities of the present general inventive concept can be achieved by providing an electronic device including a circuit board, the circuit board including: a substrate; an inductor having a core formed in a loop shape to form a hollow part, and a coil winding the core, and a supporting member including a supporting surface supporting the core to face the hollow part and a vibration preventing hole formed to correspond to the hollow part of the core, and mounting the inductor on the substrate.

The foregoing and/or other aspects and utilities of the present general inventive concept can be achieved by providing an inductor assembly, including an inductor including a loop-shaped core and a winding around the core; and a supporting member to support the inductor on one side thereof and including a hole in a center portion thereof to correspond with a center of the core.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
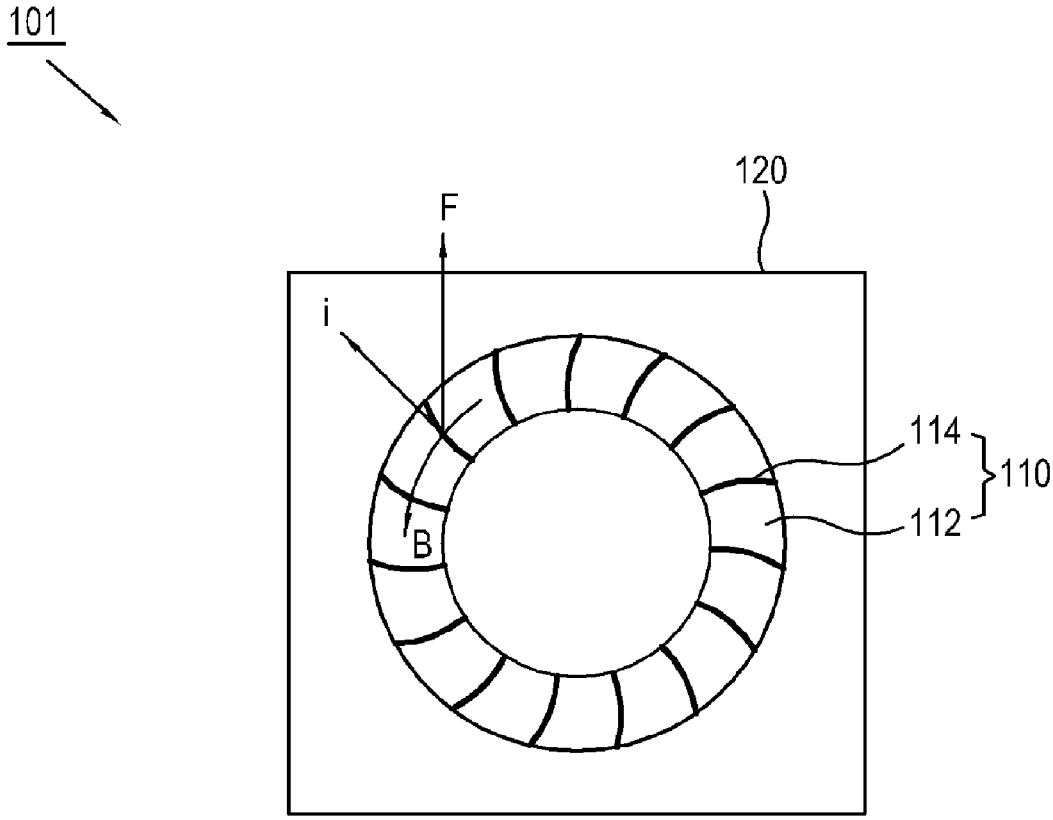
FIG. 1 (PRIOR ART)
FIG. 1 is a plane view illustrating a conventional inductor apparatus.
Figure 2:
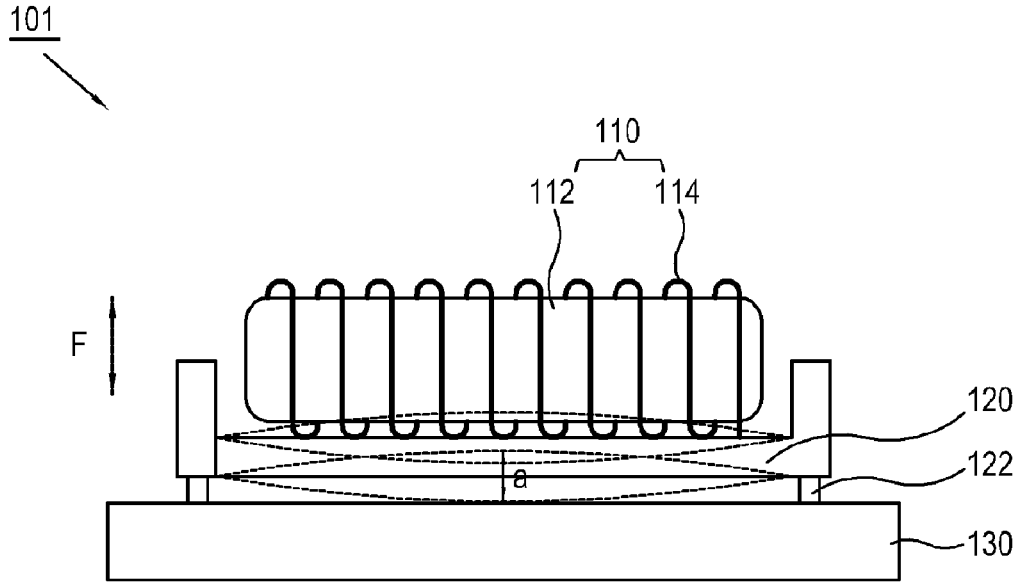
FIG. 2 (PRIOR ART)
FIG. 2 is a side view illustrating the inductor apparatus in FIG. 1, which generates vibrations.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 3:
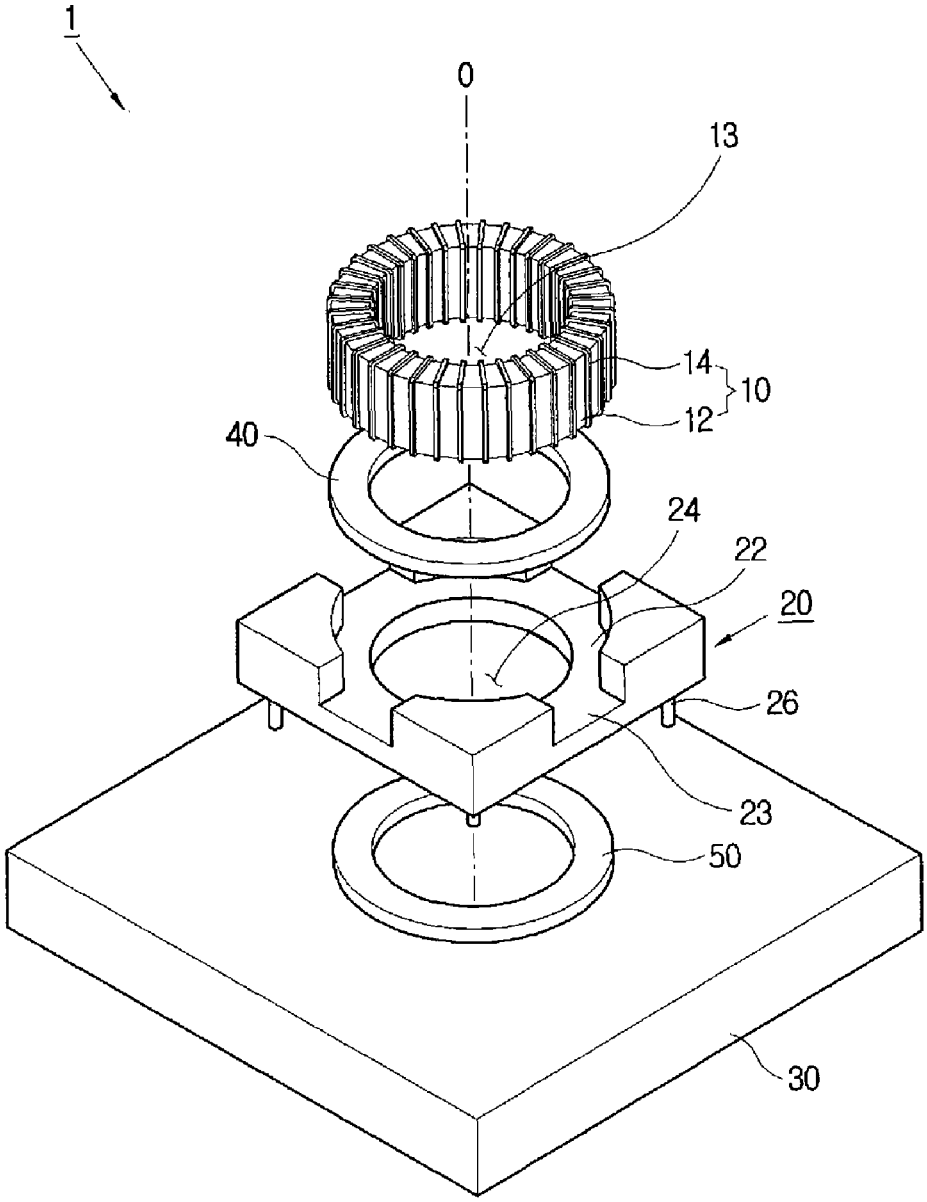
FIG. 3 is a perspective view illustrating an inductor apparatus according to an embodiment of the present general inventive concept.
Figure 4:
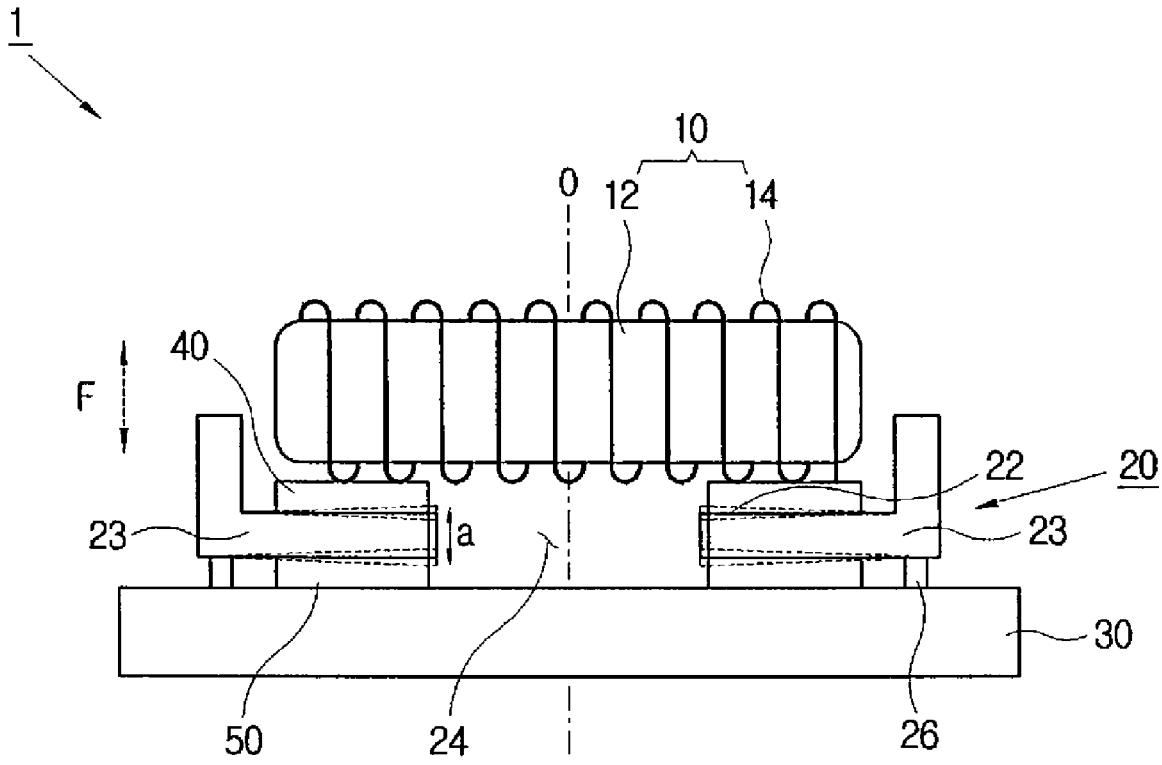
FIG. 4 is a side view illustrating the inductor apparatus in FIG. 3.

As illustrated in FIGS. 3 and 4, an inductor apparatus 1 according to an embodiment of the present general inventive concept includes an inductor 10 and a supporting member 20, and can be mounted on a substrate 30. The substrate 30 is installed in an electronic device (not illustrated) to perform a predetermined function. Other circuit elements (not illustrated) may be mounted on the substrate 30. The substrate 30 may be provided as an image signal generating driving part installed in a TV, or other circuit boards including the inductor 10. The electronic device may be provided as a TV, audio equipment or other electronic devices including the inductor 10.

The inductor 10 includes a core 12 formed in a loop shape to have a hollow part 13, and a coil 14 winding around the core 12. The core 12 is formed in a circular loop shape to form the hollow part 13, but alternatively, the core 12 may be formed in a polygonal loop shape, such as a rectangular loop shape or the like, or in a curved loop shape such as an oval loop shape or the like. The core 12 can be formed to be a closed loop, but alternatively, opposite ends of the core 12 may be distanced from each other as long as inner and outer areas thereof can be distinguishably formed. The core 12 is formed in phenolic resins or other plastics, or in iron or other metals.

The coil 14 winds around the core 12 to have a predetermined inductance, and is electrically connected to the substrate 30. The coil 14 generates an induced electromotive force based on variation of current supplied from the substrate 30. The coil 14 can wind all over the core 12 to have a predetermined pitch. Accordingly, an electromagnetic force generated from the respective parts of the core 12 can be balanced, and thereby minimize vibrations. However, alternatively, the coil 14 may wind around a part of the core 12, or the coil 14 may wind around the core 12 to have a different pitch.

The coil 14 can be provided as a PEW wire, which has one wire. Thus, vibration of the supporting member 20 can be minimized. However, alternatively, the coil 14 may be provided as a LITZ wire, which has a plurality of wires twisted around each other. The coil 14 can be liquid impregnated with an insulating varnish.

The supporting member 20 includes a supporting surface 22 to support the core 12 and to face the hollow part 13. That is, the supporting member 20 supports the inductor 10 so that an axis (O) extending through the center of the core 12 is perpendicular to a planar direction of the supporting surface 22 of the supporting member 20. The supporting member 20 includes a vibration preventing hole 24 formed through a center portion to correspond with the hollow part 13 of the core 12. The vibration preventing hole 24 can be formed in a circular shape to have the same center as the core 12 (referring to O in FIG. 3). That is, the vibration preventing hole 24 can be formed co-axially with the core 12. Accordingly, vibration of the supporting member 20 by means of an electromagnetic force generated to the coil 14 can be symmetrical with respect to the center thereof, and thereby minimize vibrations.

The vibration preventing hole 24 has a size to correspond with the hollow part 13. The vibration preventing hole 24 can have a maximized size as long as the supporting member 20 remains strong enough to support the core 12. The diameter of the vibration preventing hole 24 may be the same as the inside diameter of the core 12. The vibration preventing hole 24 can be formed in a circular shape, but alternatively, the vibration preventing hole 24 may be formed in a regular polygonal shape, a polygonal shape, an oval shape, a curved shape or other shapes as long as it is formed to correspond with the hollow part 13.

The supporting member 20 includes at least one supporting pin 26. The supporting pin(s) 26 extends from a circumference 23 surrounding the supporting surface 22 to be supported to the substrate 30. The supporting pin(s) 26 extends from an opposite side of the supporting member 20 with respect to the supporting surface 22, and couples the supporting member 20 to the substrate 30, and to thereby mount the inductor 10 on the substrate 30. Alternatively, the supporting pin(s) 26 may extend from a part of the supporting member 20 to correspond to the supporting surface 22. Also, the supporting pin(s) 26 may be omitted in view of an alternate mounting means. For example, the supporting member 20 may be supported to the substrate 30 by an adhesive or other coupling members.

Since the supporting member 20 includes the vibration preventing hole 24, the inductor apparatus 1 can minimize vibration caused by an electromagnetic force generated to the coil 14. As current flows through the coil 14, an electromagnetic force F is generated to be transferred to the core 12 and to the supporting member 20 through the supporting surface 22, and to vibrate the supporting member 20. That is, the supporting member 20 stores vibration energy, and becomes a medium for vibration. The amplitude of vibration may be at a maximum in the center of the supporting member 20 corresponding to the hollow part 13. The vibration energy stored in the supporting member 20 may be transferred to the substrate 30, and accordingly, the supporting member 20 may collide with the substrate 30 and generate noises.

However, since the supporting member 20 includes the vibration preventing hole 24 corresponding to the hollow part 13, vibration of the supporting member 20 can be reduced (refer to "a" in FIG. 4 to illustrate vibrations), and storage of vibration energy can be prevented. Accordingly, noises and vibrations caused by the electromagnetic force can be minimized.

Especially, in the case in which a high frequency current such as an image signal of a TV flows through a big capacity inductor, the supporting member 20 having the vibration preventing hole 24 can efficiently minimize noises and vibrations.

The inductor apparatus 1 includes a first vibration preventing member 40 interposed between the core 12 and the supporting member 20 and can be formed of an elastic material. The first vibration preventing member 40 may be respectively adhered to the core 12 and the supporting surface 22 by an adhesive. The first vibration preventing member 40 may be formed of rubber or a plastic material having elasticity. The first vibration preventing member 40 prevents vibration from being transferred from the core 12 to the supporting member 20. The first vibration preventing member 40 may be omitted as necessary.

The inductor apparatus 1 includes a second vibration preventing member 50 interposed between the supporting member 20 and the substrate 30 and formed of an elastic material. The second vibration preventing member 50 may be adhered to the supporting member 20 by an adhesive. The second vibration preventing member 50 may be formed of the same material as the first vibration preventing member 40, or the second vibration preventing member 50 may be formed of rubber or a plastic material having an elasticity. The second vibration preventing member 50 prevents vibration from being transferred from the supporting member 20 to the substrate 30. The second vibration preventing member 50 may be omitted as necessary.

Hereinafter, a circuit board according to an embodiment of the present general inventive concept will be described while referring to FIGS. 3 and 4.

As illustrated in FIGS. 3 and 4, a circuit board according to an embodiment of the present general inventive concept includes a substrate 30, an inductor 10, and a supporting member 20. The inductor 10 includes a core 12 formed in a loop shape to form a hollow part 13 and a coil 14 winding the core 12. The supporting member 20 includes a supporting surface 22 to support the core 12 to face the hollow part 13, and a vibration preventing hole 24 formed to correspond with the hollow part 13. The supporting member 20 mounts the inductor 10 on the substrate 30.

As described above, the inductor apparatus, the circuit board, and the electronic device using the same according to the present general inventive concept can minimize noises and vibrations caused by an electromagnetic force generated to the coil of the inductor according to variation of current.

Although a few exemplary embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An inductor apparatus comprising:

an inductor comprising a core having a loop shape to form a hollow part, and a coil winding around the core; and a supporting member comprising a supporting surface to support the core and a first vibration preventing hole to correspond with the hollow part of the core;

a first vibration preventing member formed of an elastic material located between the core and the supporting member, the first vibration preventing member having a second vibration preventing hole to correspond with the first vibration preventing hole;

a substrate to which the supporting member is mounted via supporting parts; and a second vibration preventing member formed of an elastic material to be interposed between the supporting member and the substrate, the second vibration preventing member located between the supporting parts and including a hole corresponding to the first vibration preventing hole of the supporting member.

2. The inductor apparatus according to claim 1, wherein the core is has a circular shape, and the first vibration preventing hole has an unbroken circular shape to have the same center as the core.

3. The inductor apparatus according to claim 1, wherein the core is formed in a circular shape, and the first vibration preventing hole is formed in an unbroken polygonal shape to have the same center as the core.

4. The inductor apparatus according to claim 1, wherein the core is formed in one of a circular shape, an oval shape and a polygonal shape, and the first vibration preventing hole is formed in one of a circular shape, an oval shape and a polygonal shape.

5. The inductor apparatus according to claim 4, wherein the core and the first vibration preventing hole have the same center.

6. The inductor apparatus according to claim 1, wherein the first vibration preventing hole has a size to correspond to the hollow part.

7. The inductor apparatus according to claim 1, wherein the hollow part of the core has no support element located therein.

8. The inductor apparatus according to claim 1, wherein the core is supported in a radial direction only on an outside edge of the core.

9. The inductor apparatus according to claim 1, wherein the supporting parts are located outside a cylindrical plane defined by an outer edge of the core.

10. The inductor apparatus according to claim 9, wherein the supporting member has a rectangular shape and the supporting parts are located at the corners of the supporting member.

11. The inductor apparatus according to claim 1, wherein the coil comprises a PEW wire.

12. The inductor apparatus according to claim 1, wherein the supporting parts of the supporting member are supporting pins extending from the supporting member to be mounted to the substrate.

13. A circuit board comprising:

a substrate;

an inductor comprising a core formed in a loop shape to form a hollow part, and a coil winding around the core;

a supporting member comprising a supporting surface to support the core and having a first vibration preventing hole formed to correspond with the hollow part of the core, and to mount the inductor on the substrate via supporting parts;

a first vibration preventing member formed of an elastic material located between the core and the supporting member, the first vibration preventing member having a second vibration preventing hole to correspond with the first vibration preventing hole; and a second vibration preventing member formed of an elastic material located between the supporting member and the substrate, the second vibration preventing member located between the supporting parts and including a hole corresponding to the first vibration hole of the supporting member.

14. The circuit board according to claim 13, wherein the core is formed in a circular shape, and the first vibration preventing hole is formed in an unbroken circular shape to have the same center as the core.

15. The circuit board according to claim 13, wherein the core is formed in a circular shape, and the first vibration preventing hole is formed in an unbroken polygonal shape to have the same center as the core.

16. The circuit board according to claim 13, wherein the core is formed in one of a circular shape, an oval shape and a polygonal shape, and the first vibration preventing hole is formed in one of a circular shape, an oval shape and a polygonal shape.

17. The circuit board according to claim 16, wherein the core and the first vibration preventing hole have the same center.

18. The circuit board according to claim 13, wherein the first vibration preventing hole has a size to correspond to the hollow part.

19. The circuit board according to claim 13, wherein the coil comprises a PEW wire.

20. The circuit board according to claim 13, wherein the supporting parts comprise at least one pin extending from a circumference around an outer edge of the supporting surface to the substrate.

21. An electronic device comprising a circuit board, the circuit board comprising:

a substrate;

an inductor comprising a core formed in a loop shape to form a hollow part, and a coil winding the core;

a supporting member comprising a supporting surface to support the core to face the hollow part and a first vibration preventing hole formed to correspond with the hollow part of the core, and to mount the inductor on the substrate via supporting parts;

a first vibration preventing member formed of an elastic material to be interposed between the core and the supporting member, the first vibration preventing member having a second vibration preventing hole to correspond with the first vibration preventing hole; and a second vibration preventing member formed of an elastic material to be interposed between the supporting member and the substrate, the second vibration preventing member located between the supporting parts and including a hole corresponding to the first vibration preventing hole of the supporting member.

22. An inductor assembly, comprising:

a substrate;

an inductor including a loop-shaped core and a hole winding around the core;

a supporting member to support the inductor on a first side thereof and including a first hole in a center portion thereof to correspond with a center of the core and to be mounted to the substrate via supporting parts on a second side thereof;

a first vibration preventing member formed of an elastic material to be interposed between the core and the supporting member to absorb vibrations therebetween, the first vibration preventing member having a second hole to correspond with the first hole; and a second vibration preventing member formed of an elastic material to be interposed between the supporting member and the substrate, the second vibration preventing member located between the supporting parts and including a hole corresponding to the first vibration preventing hole of the supporting member.

23. The inductor assembly according to claim 22, wherein the supporting parts comprise: a plurality of supporting pins extending from the second side of the supporting member to connect with the substrate.

* * * * *